US008541720B2

(12) United States Patent
Schwerer

(10) Patent No.: US 8,541,720 B2
(45) Date of Patent: Sep. 24, 2013

(54) APPARATUS FOR REMOTELY MEASURING SURFACE TEMPERATURE USING EMBEDDED COMPONENTS

(75) Inventor: Michael S. Schwerer, Plano, TX (US)

(73) Assignee: Raytheon Company, Waltham, MA (US)

( * ) Notice: Subject to any disclaimer, the term of this patent is extended or adjusted under 35 U.S.C. 154(b) by 229 days.

(21) Appl. No.: 13/084,811

(22) Filed: Apr. 12, 2011

(65) Prior Publication Data

US 2012/0261402 A1 Oct. 18, 2012

(51) Int. Cl.
*H05B 1/02* (2006.01)

(52) U.S. Cl.
USPC ..... 219/494; 219/497; 219/504; 219/505; 374/137; 702/130; 702/133

(58) Field of Classification Search
CPC ..... H05B 1/02; G01K 1/00; G01K 3/00
USPC ..... 219/494, 497, 499, 501, 481, 412–414; 702/130–133, 137; 374/137
See application file for complete search history.

(56) References Cited

U.S. PATENT DOCUMENTS

| | | | | |
|---|---|---|---|---|
| 4,092,862 | A | 6/1978 | Taylor | |
| 4,385,658 | A | 5/1983 | Leonard | |
| 4,929,092 | A | 5/1990 | Taguchi et al. | |
| 4,937,552 | A | 6/1990 | Lam | |
| 5,484,206 | A | 1/1996 | Houldsworth | |
| 5,741,074 | A | 4/1998 | Wang et al. | |
| 5,831,511 | A | 11/1998 | Manning et al. | |
| 5,880,365 | A | 3/1999 | Olin et al. | |
| 6,062,728 | A * | 5/2000 | Breunsbach et al. | 374/142 |
| 6,220,750 | B1 | 4/2001 | Palti | |
| 6,264,362 | B1 * | 7/2001 | Rolston | 374/29 |
| 6,278,051 | B1 * | 8/2001 | Peabody | 136/225 |
| 6,450,024 | B1 | 9/2002 | McCulloch et al. | |
| 6,666,578 | B2 | 12/2003 | Gibbs et al. | |
| 7,020,508 | B2 * | 3/2006 | Stivoric et al. | 600/390 |
| 7,397,442 | B2 | 7/2008 | Hawes | |
| 7,404,320 | B2 | 7/2008 | Sakuma et al. | |
| 7,621,180 | B2 | 11/2009 | Sakuma | |

(Continued)

FOREIGN PATENT DOCUMENTS

| | | |
|---|---|---|
| JP | 2005-133807 | 5/2005 |
| RU | 2 228 535 C1 | 10/2004 |

OTHER PUBLICATIONS

Antyufeyev, V. I., et al., "Experimental Estimation of Influence of Heated Antenna Radome on Quality of Functioning of Radiometric Information Systems of Infra-Red and Millimeter Wave Bands", International Conference on Antenna Theory and Techniques, Sevastopol, Ukraine, 3 pages, Sep. 9-12, 2003.

(Continued)

*Primary Examiner* — Mark Paschall

(57) ABSTRACT

In one embodiment, a temperature sensing apparatus includes a temperature sensor disposed in a structure at a first depth from a first surface of the structure. A heat flux sensor is also disposed in the structure at substantially the same depth as the first depth. A measurement circuit is coupled to the temperature sensor and the heat flux sensor. The measurement circuit calculates a surface temperature of the first surface based on a temperature of the temperature sensor and a heat flow of the heat flux sensor.

20 Claims, 3 Drawing Sheets

(56) References Cited

U.S. PATENT DOCUMENTS

| | | | | |
|---|---|---|---|---|
| 7,789,554 | B2 | 9/2010 | Sattler et al. | |
| 8,004,423 | B2 * | 8/2011 | Mitchell et al. | 340/870.17 |
| 8,256,953 | B2 * | 9/2012 | Yuhas et al. | 374/30 |
| 2007/0120759 | A1 | 5/2007 | Hawes | |
| 2007/0295712 | A1 | 12/2007 | Forman et al. | |
| 2007/0295713 | A1 | 12/2007 | Carlton-Foss | |

OTHER PUBLICATIONS

Dmitrienko et al., "Method Measuring Complex Dielectric Permittivity of Radio Absorption Composite Materials with Heating", RU 2 228 535 C1, English Version, 1 page, Oct. 5, 2004.

Shingo, Tanaka, Patent Abstracts of Japan, European Patent Office, Publication No. 2005133807, 1 page, May 26, 2005.

John, R., et al., Advancement of Multifunctional support structure technologies (AMFSST), Budapest, Hungary, EDA Publishing/Therminic 2007, ISBN: 978-2-35500-002-7, 6 pages, Sep. 17-19, 2007.

Pending U.S. Appl. No. 12/019,502 entitled "Apparatus for Measuring Surface Temperature Using Embedded Components" by Michael S. Schwerer, et al., 27 pages, Jan. 24, 2008.

PCT, Notification of Transmittal of the International Search Report and the Written Opinion of the International Searching Authority, or the Declaration, International Application No. PCT/US2009/030710, 11 pages, May 7, 2009.

USPTO Office Action for U.S. Appl. No. 12/019,502, 10 pages, Apr. 7, 2009.

Applicants Response to USPTO Office Action dated Apr. 7, 2009, for U.S. Appl. No. 12/019,502, 11 pages, Jul. 7, 2009.

USPTO Office Action for U.S. Appl. No. 12/019,502, 14 pages, Nov. 5, 2009.

Applicants Response to USPTO Office Action dated Nov. 5, 2009, for U.S. Appl. No. 12/019,502, 11 pages, Feb. 5, 2010.

USPTO Office Action for U.S. Appl. No. 12/019,502, 8 pages, Jun. 4, 2010.

Applicants Response to USPTO Office Action dated Jun. 4, 2010, for U.S. Appl. No. 12/019,502, 8 pages, Aug. 25, 2010.

USPTO Office Action for U.S. Appl. No. 12/019,502, 11 pages, Nov. 10, 2010.

USPTO Interview Summary for U.S. Appl. No. 12/019,502, 4 pages, Jan. 21, 2011.

Applicants Response to USPTO Office Action dated Nov. 10, 2010, for U.S. Appl. No. 12/019,502, 11 pages, Feb. 10, 2011.

USPTO Office Action for U.S. Appl. No. 12/019,502, 9 pages, Apr. 27, 2011.

Applicants Response to USPTO Office Action dated Apr. 27, 2011, for U.S. Appl. No. 12/019,502, 9 pages, Jul. 11, 2011.

* cited by examiner

APPARATUS FOR REMOTELY MEASURING SURFACE TEMPERATURE USING EMBEDDED COMPONENTS

GOVERNMENT RIGHTS

This invention was made with Government support under N00024-05-C-5346 awarded by DDG 1000. The Government may have certain rights in this invention.

TECHNICAL FIELD OF THE DISCLOSURE

This disclosure relates generally to temperature and heat flux sensors, and more particularly, to an apparatus for remotely measuring surface temperature using embedded components.

BACKGROUND OF THE DISCLOSURE

Temperature sensors have been developed to provide electrical sensing of temperature at virtually any point of interest. Common types of temperature sensors include thermocouples or resistance temperature detectors (RTDs) that utilize known variations in thermal gradients or electrical resistance, respectively, in order to generate an electrical signal representative of the temperature sensor's ambient temperature. Known manufacturing techniques have enabled the creation of temperature sensors that are relatively small in size to facilitate measurement of temperatures at correspondingly small regions of interest.

In one example, a temperature sensor may be used to determine the temperature of a surface. In certain circumstances, however, mechanical, environmental, and/or aesthetic considerations may prevent or discourage the placement of a temperature sensor on the surface being measured. As a result, two or more temperature sensors may be positioned at different depths with respect to the surface being measured. The temperature of the surface may be extrapolated from the temperatures measured by the multiple temperature sensors at the differing depths. Because extrapolation of heat flow is used to determine an estimate of the surface temperature, however, such techniques are not precise. Additionally, requiring the placement of temperature sensors at multiple depths presents fabrication challenges and other inefficiencies.

SUMMARY OF THE DISCLOSURE

In one embodiment, a temperature sensing apparatus includes a temperature sensor disposed in a structure at a first depth from a first surface of the structure. A heat flux sensor is also disposed in the structure at substantially the same depth as the first depth. A measurement circuit is coupled to the temperature sensor and the heat flux sensor. The measurement circuit calculates a surface temperature of the first surface based on a temperature of the temperature sensor and a heat flow of the heat flux sensor.

Embodiments of the disclosure may provide numerous technical advantages. Some, none, or all embodiments may benefit from the below described advantages. According to one embodiment, measurement of a surface of a structure may be obtained without placement of temperature sensors directly on the surface. This feature may be particularly beneficial for systems where direct placement of a temperature sensor on a particular surface is not practical or may hamper the performance of other associated mechanisms that may use this surface. For example, there are known radome designs that incorporate environmental coatings which are not well suited for placement of temperature sensors directly on their surface. Placement under the surface of the environmental coating may protect the temperature sensors from potentially harsh environments, such as radiation, reactive chemicals, extreme temperatures, physical impact, and/or severe weather. Additionally, embedding the sensors in the wall of a piping structure or tank or placement on the outer surface isolates the sensors from the wear of fluid flow or damage by hazardous or caustic chemicals contained therein yet allows accurate measurement of the fluid temperature.

Because the heat flux is directly measured, rather than extrapolated from temperature sensors at differing depths, a more accurate indication of the surface temperature may be obtained. Additionally, eliminating the need to embed sensors at varying depths within the structure enables the construction of the structure and the electrical connections to the sensors to be simplified.

Other technical advantages will be apparent to one of skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS OF THE DISCLOSURE

As previously described, the relatively small thickness of temperature sensors has enabled measurement of temperatures at relatively small regions of interest. There are some devices, however, for which temperature measurement using these temperature sensors are still generally impractical. For example, placement of a temperature sensor directly on an outer surface of a radome may be generally impractical due to environmental coatings on its outer surface. A radome is a type of covering that may be placed over an antenna for shielding the various elements of the antenna from the environment. It may be desired in some cases, however, to measure the outer surface of the radome. During inclement weather conditions, a layer of ice may form on the outer surface of the radome that may hamper proper operation of the antenna. A temperature sensor may be used to monitor the outer surface for icing conditions; however, this sensor is unprotected and, therefore, at risk of damage due to external hazards.

Figure 1:
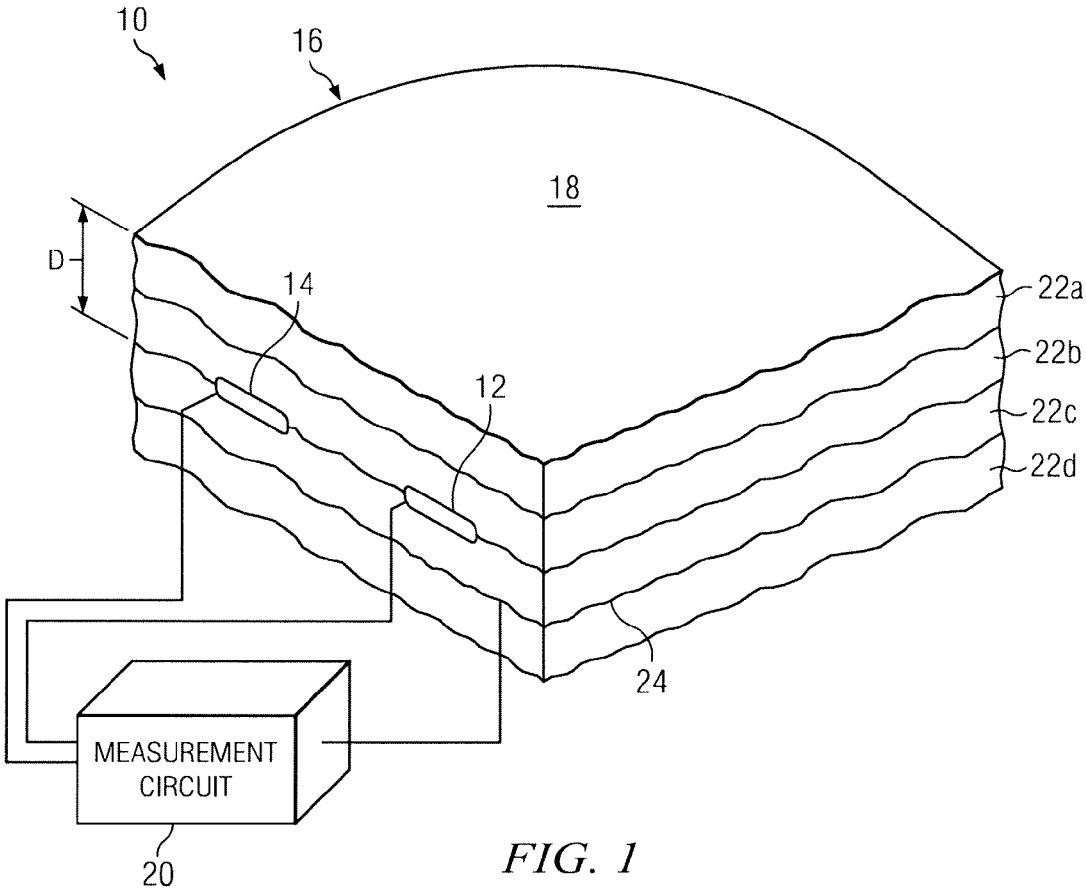
FIG. 1 is a partial perspective view of one embodiment of a temperature sensing apparatus that is configured on a structure.

FIG. 1 shows one embodiment of a temperature sensing apparatus 10 for measuring surface temperature using embedded components according to the teachings of the present disclosure. Temperature sensing apparatus 10 generally includes a temperature sensor 12 and a heat flux sensor 14 that are disposed in a structure 16 at substantially the same depth D from an outer surface 18 of the structure 16. A measurement circuit 20 is coupled to the temperature sensor 12 and the heat flux sensor 14. Measurement circuit 20 is operable to calculate the temperature of the outer surface 18 based on a measured temperature of the temperature sensor 12 and a calculated temperature difference between the temperature sensor 12 and the surface 18 at any point in time. The calculated temperature difference is determined based on the heat flux measured by the heat flux sensor.

In certain embodiments, structure 16 may be formed of a number of layers 22 that are disposed adjacent to one another. The layers 22*a*, 22*b*, 22*c*, and 22*d* may be formed of any suitable material. In one embodiment, layers 22*a*, 22*b*, 22*c*, and 22*d* may be made of a similar material. In another embodiment, layers 22*a*, 22*b*, 22*c*, and 22*d* may each be made of differing materials. For example, each of layers 22 may be formed of one or a combination of quartz laminate, fiberglass, RAYDEL™, KAPTON™, or other material that may provide beneficial electro-magnetic and/or structural characteristics.

In a particular exemplary example, temperature sensor 12 may be disposed between layer 22*b* and 22*c* such that the thermal resistance between the outer surface 18 and temperature sensor 12 is a function of the material(s) from which layers 22*a* and 22*b* are formed. Alternatively, temperature sensor 12 could be disposed between layers 22*a* and 22*b* or between 22*c* and 22*d*. Further, although temperature sensor 12 is depicted as being disposed along the boundary between two layers of 22, it is recognized that temperature sensor 12 may be disposed at any location within 22. Heat flux sensor 14 is nominally placed at the same depth as temperature sensor 12.

Temperature sensor 12 may be any suitable type that is operable to create an electrical signal representative of an ambient temperature. In one embodiment, temperature sensor 12 may be a thermocouple that is configured to generate an electrical voltage that is a temperature dependent function of the dissimilar metals from which it is made. In another embodiment, temperature sensor 12 may be a resistance temperature detector (RTD). A resistance temperature detector provides relatively accurate temperature measurement using materials with a known resistance that varies predictably according to its ambient temperature. Materials commonly used for this purpose may include platinum or palladium, which are relatively stable over a wide temperature range. In another embodiment, temperature sensor 12 may be a 2-wire, 3-wire, or 4-wire resistance temperature detector. However, it may be recognized that a 2-wire resistance temperature detector may not be as accurate as a 3-wire or 4-wire resistance temperature detector.

In order to provide relatively accurate measurement of the heat flow (Q), heat flux sensor 14 may be disposed at substantially the same depth as and in relatively close proximity to temperature sensor 12. Accordingly, where temperature sensor 12 is disposed between the two layers 22*b* and 22*c*, heat flux sensor 14 may also be disposed between the two layers 22*b* and 22*c* at a location that is substantially the same depth D from outer surface 18 as the location of temperature sensor 12. Specifically, heat flux sensor 14 is a transducer that generates an electrical signal proportional to the heat flowing toward surface 18. The measured heat flux is multiplied by the surface area of the heat flux sensor 14 to determine the heat flow (Q). In one embodiment the heat flow may be measured in Watts and the surface area may be measured in square inches, and the heat flux is measured in Watts per square inch. Though described as including a heat flux transducer, heat flux sensor 14 may alternatively include heat flux gauges or heat flux plates.

For calculating the temperature of outer surface 18, system 10 includes a measurement circuit 20. Measurement circuit 20 may be any type of circuit operable to calculate the temperature of the outer surface 18 using signals received from temperature sensor 12 and heat flux sensor 14. In one embodiment, measurement circuit 20 may be a digital circuit, such as a processor-based computer circuit in which calculation of the temperature of the outer surface 18 is performed using digital signals. In another embodiment, measurement circuit 20 may be an analog circuit such that calculation of the outer surface temperature is accomplished using known analog circuit techniques.

According to the teachings of the present disclosure, calculation of the temperature of the outer surface 18 may be provided using known thicknesses and thermal resistance values of materials from which the structure 16 is made along with known heat flow values existing in the structure and an internal reference temperature. As described above, embedded temperature sensor 12 and heat flux sensor 14 are located at the substantially the same level or depth within structure 16. Based on the known thermal conductivity to the outer surface 18 and the thickness to the surface along with measured heat flux provided by heat flux sensor 14, measurement circuit 20 may operate to calculate a temperature difference between the outer surface 18 and temperature sensor 12. The temperature difference can be combined with the measured temperature of temperature sensor 12 to derive the temperature of outer surface 18.

In one embodiment, a heater element 24 may be provided that is disposed on a surface of the structure 16. The measurement circuit 20 may be coupled to heater element 24 and operable to selectively apply electrical power to the heater element 24 such that the temperature of outer surface 18 may be controlled. Measurement circuit 20 may selectively apply heat to the heater element 24 using any suitable control loop. In one embodiment, measurement circuit 20 may be implemented with a cascading control loop for controlling the temperature of the outer surface 18. In another embodiment, measurement circuit 20 may be implemented with a proportional/integral/derivative (PID) control loop for controlling the temperature of the outer surface 18. In another embodiment, measurement circuit 20 may be implemented with a combination of a cascading control loop and a proportional/integral/derivative (PID) control loop for controlling the temperature of the outer surface 18.

Figure 2:
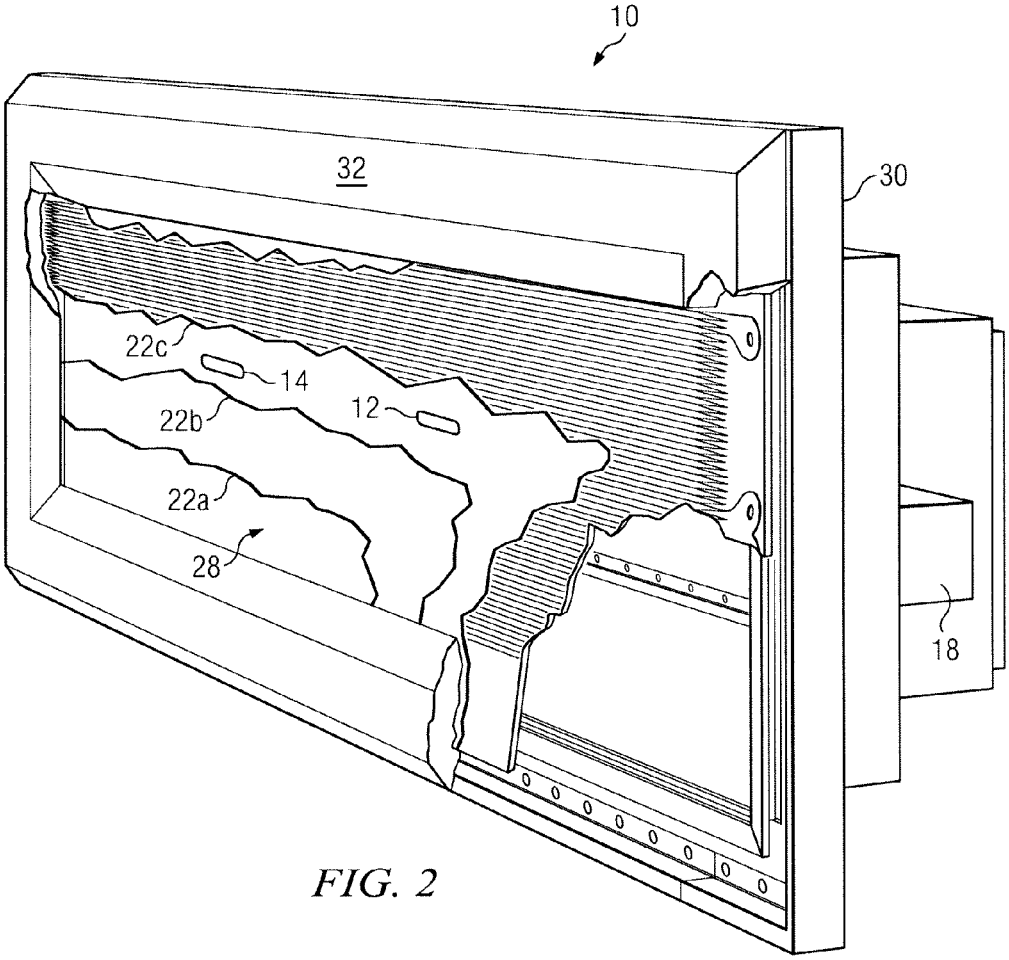
FIG. 2 is a perspective view of another embodiment of a temperature sensing apparatus that is configured on a radome of an antenna.

FIG. 2 shows one particular embodiment of a temperature sensing apparatus 10 that may be implemented on radome 28 in which several layers 22 have been peeled away to reveal several components of the temperature sensing apparatus 10. As described previously, radome 28 may be configured to cover the opening of an antenna 30 for shielding various elements (not specifically shown) of the antenna 30 from the environment. In one embodiment, the radome 28 may be formed of a number of layers 22*a*, 22*b*, and 22*c* such that temperature sensor 12 is disposed between layers 22*b* and 22*c*. It is recognized, however, that temperature sensor 12 may be disposed between layers 22*a* and 22*b* or any other layers within radome 28.

Where temperature sensor 12 and heat flux sensor 14 are disposed between layers 22*b* and 22*c*, heater element 24 may be disposed on a surface of the layer 22*c*. In one embodiment, heater element 24 may be substantially flat and extend over the surface of layer 22*c* for heating the outer surface of 22 of the radome 28 in a relatively even manner. In the particular embodiment shown, one temperature sensing apparatus 10 is implemented for determining the temperature of the outer surface 18; however, a number of temperature sensing apparatuses 10 may be disposed at various locations on the radome 28.

An outer ring 32 may be included for mounting the edge of the radome 28 to the antenna 30 and/or controlling the radiation pattern of the antenna 30. A field region of the radome 28 generally refers to a portion of the radome 28 that is surrounded by the outer ring 32. It is through this field region that electro-magnetic radiation may pass. In one embodiment, temperature sensor 12 may be disposed within this field region for providing a relatively accurate measurement of the outer surface 18 where electro-magnetic radiation may be undesirably affected by the presence of ice.

Figure 3:
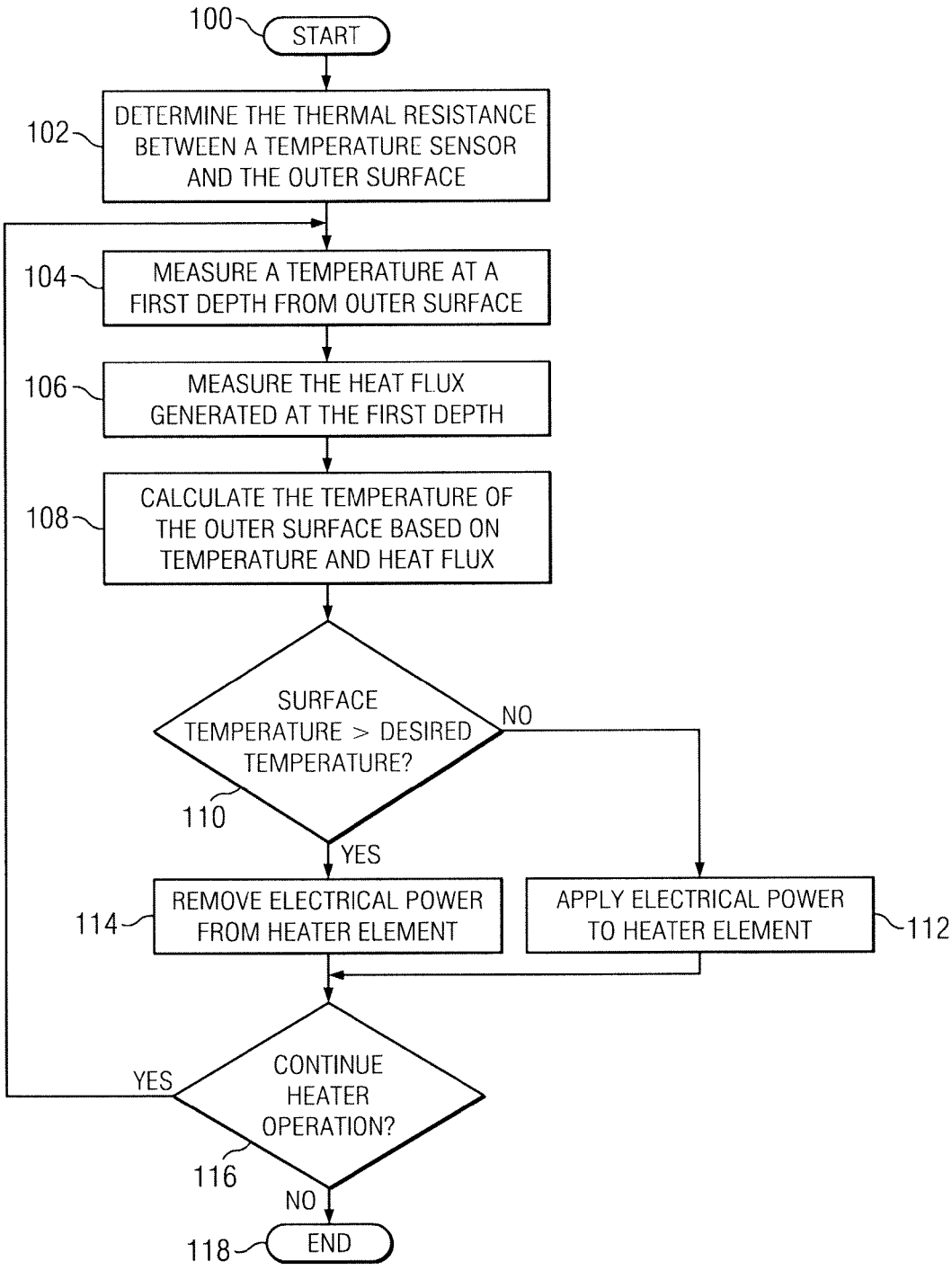
FIG. 3 is a flowchart showing several actions that may be taken by the temperature sensing apparatus of FIG. 1 or 2 to measure the temperature of the desired surface.

FIG. 3 shows a series of actions that may be performed to measure the temperature of the outer surface 18 of a structure 16, such as a radome 28 or, alternatively, the inner surface of a tank or pipe. In act 100, the process is initiated. The process may be initiated by applying electrical power to the measurement circuit 20 such that the measurement circuit 20 may process signals from the temperature sensor 12 and heat flux sensor 14 and perform other functions as described below.

In act 102, the thermal resistance between temperature sensor 12 and outer surface 18 may be determined. The thermal resistance generally refers to a resistance to the movement of thermal energy through a material, which in this particular case is the material from which the structure, such as a radome 28, is made. In one embodiment, thermal resistance values may be estimated as a function of the intrinsic thermal resistivity of the material(s) and the thickness(es) (totaling D) between temperature sensor 12 and the outer surface 18.

In another embodiment, thermal resistance values may be determined by calibrating the temperature sensing apparatus 10 in which the thermal resistance of layers 22*a* and 22*b* are measured. Calibration of the temperature sensing apparatus 10 may be performed following manufacture and/or periodically throughout its serviceable life. The temperature measurement apparatus 10 may be calibrated by measuring various temperature values of temperatures sensor 12 while the outer surface 18 is subjected to a range of temperatures. In this particular embodiment, a non-permanent temperature sensor may be temporarily attached to the outer surface 18 for temperature measurement of the outer surface 18. While the structure is subjected to different steady state heat flow conditions, measured values may be obtained from temperature sensor 12 and heat flux sensor 14. These measured values may then be used to derive apparent thermal resistance values that may then be used as calibration factors for calculating the outer surface temperature during operation of the temperature sensing apparatus 10. Certain embodiments incorporating a calibration process may provide an advantage in that apparent thermal resistance values may be determined for each structure 16 manufactured in order to cancel distribution error that may occur during the manufacturing process.

Acts 104 through 108 describe one embodiment of a method of operation of the temperature sensing apparatus 10. In act 104, the temperature sensing apparatus 10 may measure a first temperature of structure 16 at a first depth from outer surface 18 using temperature sensor 12. In act 106, heat flux sensor 14 may measure the heat flow (Q) through the heat flux sensor 14 based on the measured heat flux multiplied by the sensor area of the heat flux sensor 14. Using the measured temperature value from step 104 and the measured heat flow (Q) from step 106, the measurement circuit 20 may then calculate the outer surface temperature of structure 16 at step 106. Specifically, measurement circuit 20 may calculate the outer surface temperature (Ts) of structure 16 according to the formula:

$$Ts=T1-Q*R$$

where:

T1—measured temperature of temperature sensor 12

Q—heat flow (heat flux*sensor area of sensor 14)

R—thermal resistance of the layers between temperature sensor 12 and outer surface 18 of structure 16

As stated above, thermal resistance (R) is calculated based on the distance between temperature sensor 12 from outer surface 16 and, the thermal resistivity of the material. Specifically, the measurement circuit 20 may utilize the thermal resistance (R) according to the formula:

$$R=D/(K*A)$$

where:

D—depth of temperature sensor 12 from outer surface 18

K—thermal conductivity

A—sensing area of heat flux sensor 14

Thus, the formula for calculating the outer surface temperature (Ts) of structure 16 may be considered:

$$Ts=T1-Q*[D/(K*A)]$$

where:

T1—measured temperature of temperature sensor 12

Q—heat flow (heat flux*sensor area of sensor 14)

D—depth of temperature sensor 12 from outer surface 18

K—thermal conductivity

A—sensing area of heat flux sensor 14

For example, the heat flow may be important in the case of a surface coated with ice. The latent heat of fusion of the ice will draw out more heat than water at the same freezing temperature. In this circumstance the greater heat flow will indicate a colder temperature at the surface than would physically be measured. The end result is that the control system may operate to compensate for the colder temperature by supplying more heat, which is as required in the presence of ice.

In a particular embodiment in which heat movement through layer 22*c* or layer 22*d* may not unduly affect the accuracy of the calculated temperature, layer 22*c* may not be needed. Thus, heater element 24 may be configured adjacent temperature sensor 12.

In one embodiment, the measurement circuit 20 may selectively provide electrical power to heater element 24 for controlling the outer surface temperature. Control of the outer surface temperature may be provided using a control loop configured in measurement circuit 20. In one embodiment, measurement circuit 20 may incorporate a cascading control loop. In another embodiment, measurement circuit 20 may incorporate a proportional-integral-derivative (PID) control loop. The proportional-integral-derivative control loop may provide an advantage in that each portion of the PID control loop may be selectively weighted for tuning the control loop. That is, various weightings of the proportional, integral, or derivative portions of the PID control loop may be individually weighted to counteract any foreseeable temperature rate changes or extremes to which the structure 14 may be subjected during operation.

At step 110, measurement circuit 20 determines if the outer surface temperature of outer surface 18 (as determined at step 108) is greater than a desired temperature. If the outer surface temperature of outer surface 18 is not greater than the desired temperature, electrical power is applied to heater element 24 at step 112. The measurement circuit 20 may determine how much power to apply, in certain embodiments. The application of electrical power may result in an increase in the outer surface temperature of outer surface 18. Conversely, if the outer surface temperature of outer surface 18 is greater than the desired temperature, electrical power is removed from heater element 24 at step 114. The removal of electrical power may result in a decrease in the outer surface temperature of outer surface 18. The control loop determines the timing of the power application and or the amount of power applied.

At step 116, a determination is made as to whether to continue the heater operation. If the heater operation should continue, the method returns to step 104, and the temperature at a first depth may be measured. Steps 104 through 116 may repeated throughout operation of the temperature sensing apparatus 10. When it is determined at step 116, that measurement of the outer surface 18 is no longer needed or desired, operation of the measurement circuit 20 may be halted in which case the process is ended in act 118.

A temperature sensing apparatus 10 has been described that may provide temperature sensing of a surface 18 without the need for placement of temperature sensors 12 directly on the surface 18. Using measurements provided by a temperature sensor 12 and a heat flux sensor 14 placed at substantially the same depth (D) from the surface 18, a relatively accurate measurement of the surface 18 may be obtained. The temperature sensing apparatus 10 may be particularly beneficial in scenarios where direct placement of a temperature sensor at a point of interest is impractical or may hamper the performance of other associated mechanisms that may use this surface 18. Because the temperature sensor 12 and the heat flux sensor 14 are located at the same layer, construction of structure 16 and electrical connections to sensors is simplified. Furthermore, because the heat flux is directly measured, rather than extrapolated from temperature sensors at differing depths, a more accurate indication of the surface temperature may be obtained.

Although the present disclosure has been described in several embodiments, a myriad of changes, variations, alterations, transformations, and modifications may be suggested to one skilled in the art, and it is intended that the present disclosure encompass such changes, variations, alterations, transformations, and modifications as falling within the spirit and scope of the appended claims.

What is claimed is:

1. A temperature controlling apparatus comprising:

a radome having at least a first layer, a second layer and a third layer that are disposed adjacent one another, the first layer having a first surface opposite the second layer;

a temperature sensor disposed between the first layer and the second layer;

a heat flux sensor, separate from the temperature sensor, disposed between the first layer and the second layer;

a heater element disposed on a second surface of a third layer opposite the second layer; and a measurement circuit coupled to the temperature sensor, the heat flux sensor, and the heater element, the measurement circuit operable to:

calculate an outside surface temperature of the radome based on a temperature of the temperature sensor and the heat flux of the heat flux sensor; and control the outside surface temperature of the radome by selectively applying electrical power to the heater element based on the calculated outside surface temperature.

2. A temperature sensing apparatus comprising:

a temperature sensor disposed in a structure at a first depth from a first surface of the structure;

a heat flux sensor, separate from the temperature sensor, disposed in the structure at substantially the same depth as the first depth; and a measurement circuit coupled to the temperature sensor and the heat flux sensor and operable to calculate a surface temperature of the first surface based on a temperature of the temperature sensor and a heat flux of the heat flux sensor.

3. The temperature sensing apparatus of claim 2, wherein the structure comprises a first layer and a second layer, the first layer including the first surface of the structure, the temperature sensor being disposed between the first layer and the second layer and the heat flux sensor being disposed between the first layer and the second layer.

4. The temperature sensing apparatus of claim 2, wherein the structure comprises a first layer, a second layer, and a third layer, the first layer including the first surface of the structure, the temperature sensor being disposed between the second layer and the third layer and the heat flux sensor being disposed between the second layer and the third layer.

5. The temperature sensing apparatus of claim 2, wherein the measurement circuit is operable to determine the first surface temperature based on a known thermal resistance, a known thickness of any layers disposed between the temperature sensor and the first surface, and the heat flow through the layers disposed between the heat flux sensor and the first surface.

6. The temperature sensing apparatus of claim 2, wherein the structure is a radome.

7. The temperature sensing apparatus of claim 6, wherein the heat flux sensor is a transducer.

8. The temperature sensing apparatus of claim 2, further comprising a heater element disposed in the structure at a second depth from the first surface, the second depth being greater than or equal to the first depth, the measurement circuit coupled to the heater element and operable to control the surface temperature by selectively applying electrical power to the heater element using the calculated surface temperature.

9. The temperature sensing apparatus of claim 8, wherein the measurement circuit is operable to control the temperature of the first surface using a cascading control loop algorithm.

10. The temperature sensing apparatus of claim 8, wherein the measurement circuit is operable to control the temperature of the first surface using a proportional/integral/derivative (PID) control loop algorithm.

11. The temperature sensing apparatus of claim 8, wherein the measurement circuit is operable to control the temperature of the first surface using a cascading control loop algorithm and a proportional/integral/derivative (PID) control loop algorithm.

12. A method comprising:

measuring a temperature of a structure at a first depth from a first surface;

measuring a heat flow of the structure, separate from measuring the temperature of the structure, at the first depth from the first surface;

calculating a surface temperature of the first surface based on the temperature at the first depth from the surface and the heat flow at the first depth from the first surface.

13. The method of claim 12, wherein measuring the temperature of the structure further comprises measuring a temperature of a radome.

14. The method of claim 12, further comprising controlling the surface temperature of the first surface by applying electrical power to a heater element disposed a second depth from the first surface, the second depth being greater than or equal to the first depth.

15. The method of claim 14, wherein controlling the surface temperature of the first surface further comprises controlling the surface temperature using a proportional/integral/derivative (PID) control loop algorithm.

16. The method of claim 14, wherein controlling the surface temperature of the first surface further comprises controlling the surface temperature using a cascading control loop algorithm.

17. The method of claim 14, wherein controlling the surface temperature of the first surface further comprises controlling the surface temperature using a proportional/integral/derivative (PID) control loop algorithm and a cascading control loop algorithm control loop algorithm.

18. The method of claim 12, further comprising removing electrical power to the heater element if a heater element temperature exceeds a threshold temperature.

19. The method of claim 14, wherein applying electrical power to the heater element further comprising applying, using a silicon controlled rectifier, electrical power to the heater element at a zero crossing point.

20. The method of claim 12, wherein calculating a surface temperature of the first surface further comprises calculating the surface temperature of the first surface based on a first known thermal resistance and a first thickness of the structure at the first depth and the heat flow at the first depth from the first surface.

* * * * *